United States Patent [19]

Lieberman

[11] Patent Number: 5,040,483

[45] Date of Patent: Aug. 20, 1991

[54] WALLPAPER TRAY

[76] Inventor: Harold N. Lieberman, P.O. Box 3789, Gaithersburg, Md. 20885-3789

[21] Appl. No.: 570,058

[22] Filed: Aug. 20, 1990

[51] Int. Cl.[5] ..... B05C 3/12

[52] U.S. Cl. ..... 118/419; 118/428; 118/429; 118/DIG. 17

[58] Field of Search ..... 118/419, 423, 429, DIG. 17, 118/428

[56] References Cited

U.S. PATENT DOCUMENTS

| | | | |
|---|---|---|---|
| 2,440,481 | 4/1948 | Lowery | 118/DIG. 17 |
| 2,794,419 | 12/1954 | Warner et al. | 118/419 |
| 2,898,883 | 8/1959 | Reid et al. | 118/419 |
| 3,788,270 | 1/1974 | Blair | 118/DIG. 17 |
| 4,244,320 | 1/1981 | McCurdy | 118/235 |
| 4,300,471 | 11/1981 | Desjardins | 118/235 X |
| 4,377,983 | 3/1983 | Skarsten | 118/42 |
| 4,934,311 | 6/1990 | Topelko | 118/419 |

*Primary Examiner*—Michael Wityshyn
*Attorney, Agent, or Firm*—Sughrue, Mion, Zinn, Macpeak & Seas

[57] ABSTRACT

A tray is provided for dispensing and wetting pre-pasted wallpaper. The tray features a trough and a dispenser rod for holding a roll of wallpaper. The wallpaper can be extended to a desired length and cut directly from the dispenser rod. The cut wallpaper is then placed on a shelf adjacent to a trough containing a wetting agent. The wallpaper is passed under the shelf and through the trough being guided by a guide submersed in the trough to ensure proper wetting. The paper is then withdrawn from the trough and hung on the desired surface.

12 Claims, 3 Drawing Sheets

WALLPAPER TRAY

BACKGROUND OF THE INVENTION

The present invention relates generally to an improved tray for dispensing and wetting pre-pasted wallpaper. Generally, modern wallpaper is pre-pasted. That is to say, paste is applied at the factory and dried on the back of the paper. The paper is then bundled into tightly-turned rolls for sale. Accordingly, the user must unroll a portion of paper and cut it to size before wetting.

To hang the paper, the user must wet the paper in a prescribed manner and then affix it to the surface to be papered. In order to perform the paper hanging in a durable manner, having no air bubbles, and further so that the paper will not shrink, the paper must be uniformly wetted with a very short maximum dwell time in the wetting medium. Generally, the maximum dwell time for wetting the paper is in the range of 10 to 15 seconds.

Currently, a simple rectangular tray is available for a user to wet pre-pasted wallpaper. In order to cut the wallpaper to a desired size, the roll end must be restrained, the wallpaper must be unrolled, the roll itself then restrained, and the desired piece measured and cut. This cumbersome process can be extremely difficult to accomplish by one person. After cutting the paper to size, the user must reverse the roll of paper in order to remove some of the inherent "memory" which results from the paper being rolled at the factory, re-roll the cut piece, immerse it in the tray, and remove it extremely quickly in order to avoid overwetting the adhesive.

When using the rectangular tray currently available, an undesirable result is often obtained due to inconsistent wetting of the adhesive over the length of the cut piece. This results in poor adhesion, which may be manifested in the form of bubbles or separating edges occurring months after installation. The non-uniform wetting is caused by the fact that a rolled piece is immersed in the tray, and contact between the finished surface of an interior layer and the pasted surface of the next layer is therefore unavoidable.

Using the rectangular tray of the prior art is extremely cumbersome, and may require a second person to hold the cut piece of paper under the surface of the water as the end is being withdrawn, since the paper is not otherwise restrained. Further, the possibility of non-uniform wetting and the cumbersome aspects of withdrawing the paper make control of the total wetting time uncertain. Finally, since the prior art contains no dispenser, it is difficult to measure and cut the wallpaper with the rectangular tray of the prior art.

SUMMARY OF THE INVENTION

The present invention has been developed in order to overcome the above-noted disadvantages inherent in the wallpaper tray of the prior art. The present invention is a tray having a dispenser rod to hold a roll of pre-pasted wallpaper. A wallpaper shelf is integral to or affixed to the tray. A trough is provided to hold a wetting agent, such as water. A guide is attached to the trough and extends across the trough below the liquid level. The advantages of the present invention include the ease of working with the wallpaper and the fact that the wallpaper can be cut and wetted easily by one person. Yet another benefit of the present invention is that the wallpaper is uniformly wetted because the layers of the wallpaper do not touch each other during the wetting process.

These and other objects of the present invention will be made clear upon review of the following detailed description when taken together with the drawings.

DESCRIPTION OF THE PREFERRED EMBODIMENT

Figure 2:
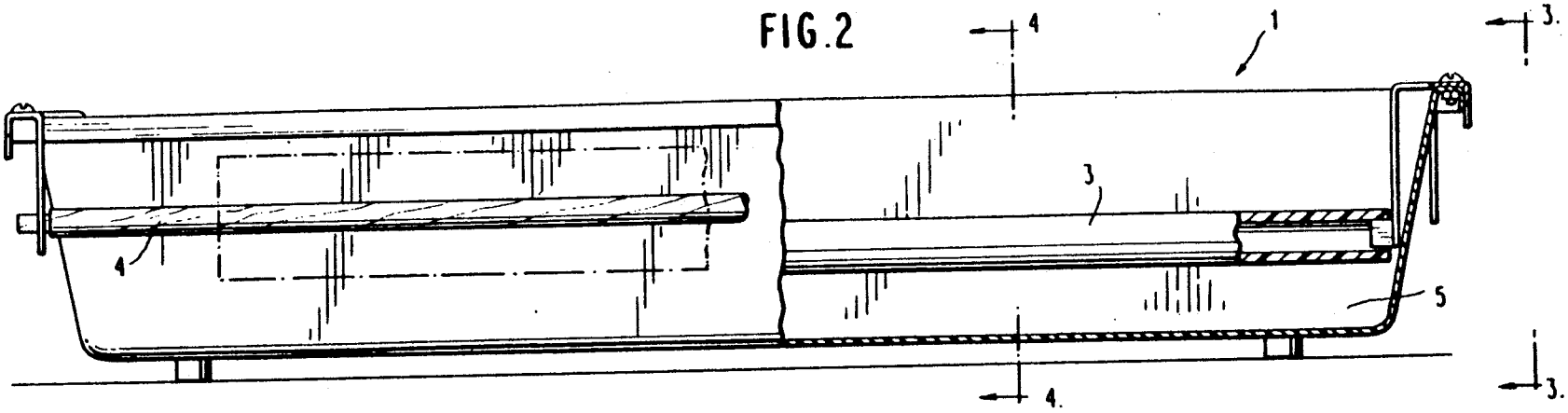
FIG. 2 is a sectional view of the present invention taken along line 2—2 of FIG. 1.
Figure 1:
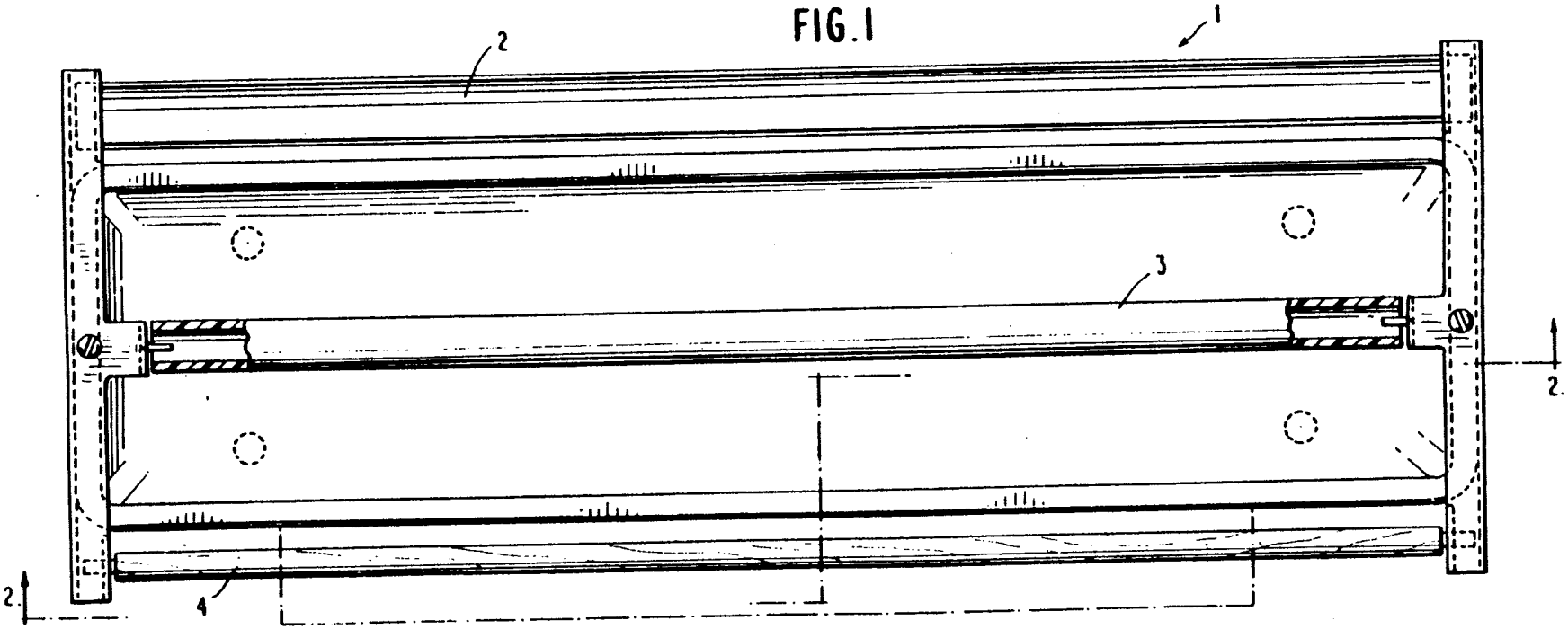
FIG. 1 is a top view of a preferred embodiment of the wallpaper tray of the present invention.
Figure 4:
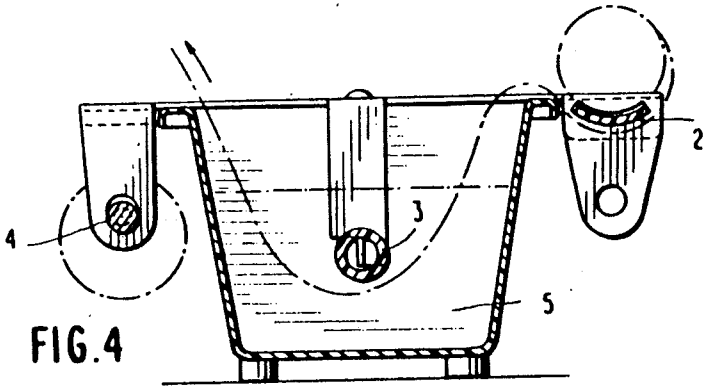
FIG. 4 is a cross-sectional view of the present invention taken along line 4—4 of FIG. 2.
Figure 3:
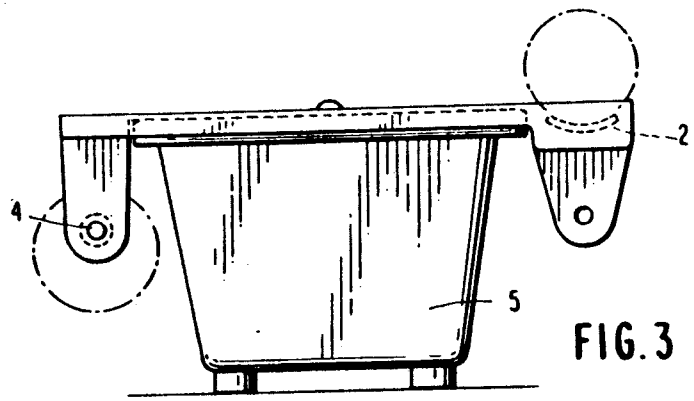
FIG. 3 is an end view of the present invention taken along line 3—3 of FIG. 2.
Figure 5:
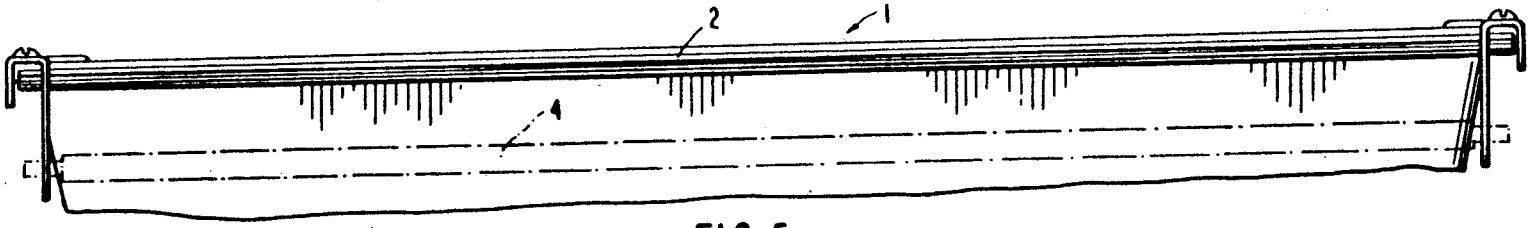
FIG. 5 is a fragmentary view of a side of the present invention opposite to that shown in FIG. 2.

Referring to FIGS. 1-3, the wallpaper tray of the present invention is described in the detail below. As noted above, the present invention is directed to an improved wallpaper dispensing and wetting tray to substantially aid in wallpaper pasting and cutting. The tray is generally designated in the figures as reference numeral 1. The tray 1 includes a dispenser rod 4 to hold a roll of pre-pasted wallpaper. A wallpaper shelf 2 is integral to or affixed to the tray 1. A trough 5 is provided to hold a wetting agent such as water. A guide 3 is attached to the trough 5 as shown in FIG. 4 and extends across the trough 5 below the liquid level.

In operation, a section of wallpaper to be wetted is pulled to a desired length, temporarily weighted, and cut off of the roll from the dispenser rod 4. As shown in FIG. 4, the cut section is then placed on the wallpaper shelf 2. Next, an end of the cut wallpaper is drawn to pass under the wallpaper shelf 2. The wallpaper is then pulled over the edge of the tray 1 and passed under the guide 3, and withdrawn to the surface of the tray.

In this way, since the wallpaper is not wetted in the form of a roll, the problem of uneven wetting of the prior art is overcome. Further, the dwell time for wetting the wallpaper is easily controlled by the speed at which the wallpaper is withdrawn from the tray.

For very heavy wallpaper, or for cases in which contact of the glued surface with guide 3 would be undesirable, the cut section may be placed underneath the shelf, with the end passing over the shelf, and with the finished side of the paper facing up. The paper is then pulled under guide 3 and withdrawn as previously described.

It will be apparent, then, that the shelf edge provides restraint of the cut section while still permitting the end to feed into tray 1 and under guide 3.

The shelf, then, may be of any convenient orientation and shape which will result in permitting the cut section to be drawn into tray 1 and under guide 3 while unrolling outside the tray.

In this embodiment of the present invention, the dispenser rod 4 is provided either on a side of the tray 1 which is opposite to the side on which the wallpaper shelf 2 is located, as shown in FIG. 4, or in the alternative, the dispenser rod 4 may be located underneath the wallpaper shelf 2. By providing the dispenser rod 4 at the opposite side of the tray 1, the user is permitted to both cut and wet the paper on a convenient surface, such as a table, without the necessity of turning the apparatus around. Further, the flexibility of the user selecting which position he wants the dispenser rod 4 to be located offers further ease of use.

Figure 10:
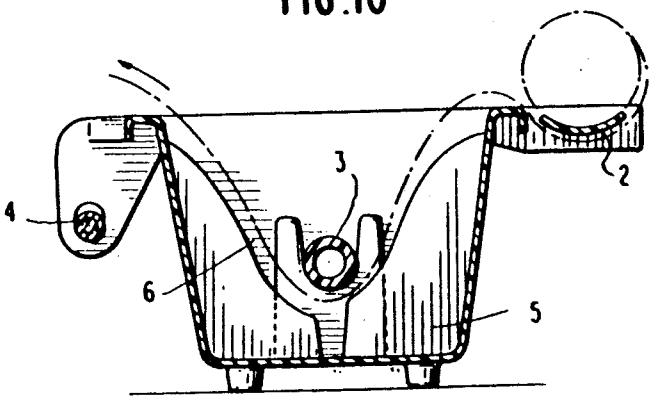
FIG. 10 is a transverse sectional view taken along line 10—10 of FIG. 7.
Figure 6:
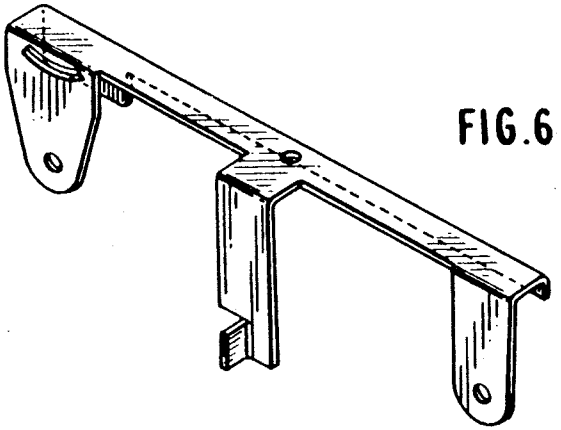
FIG. 6 is a perspective view of the bracket used in the present invention.
Figure 7:
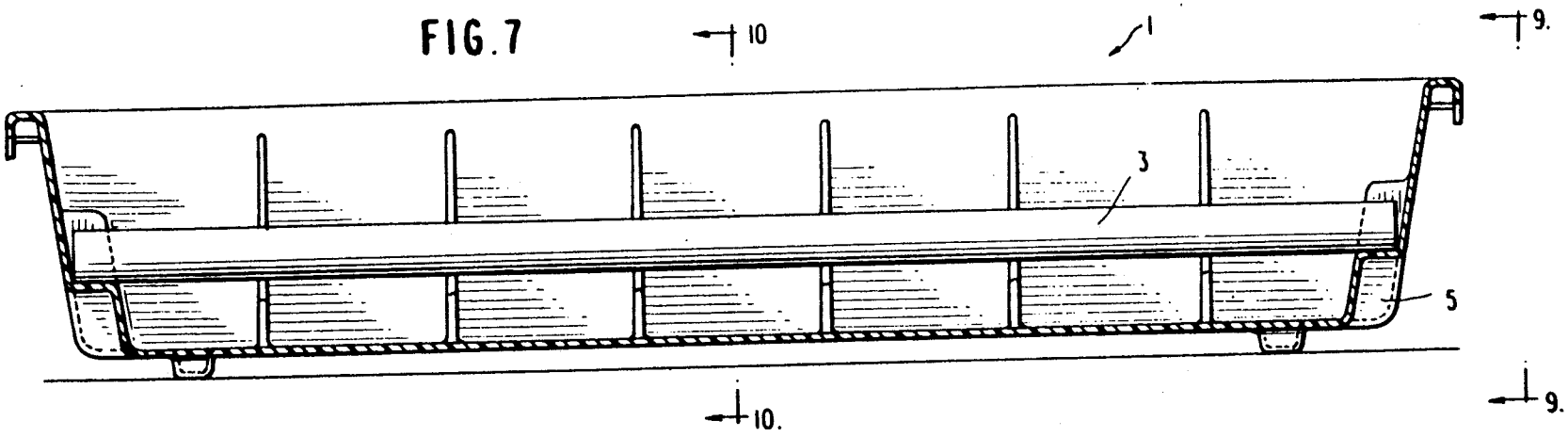
FIG. 7 is a longitudinal cross-sectional view of a molded version of the present invention.
Figure 9:
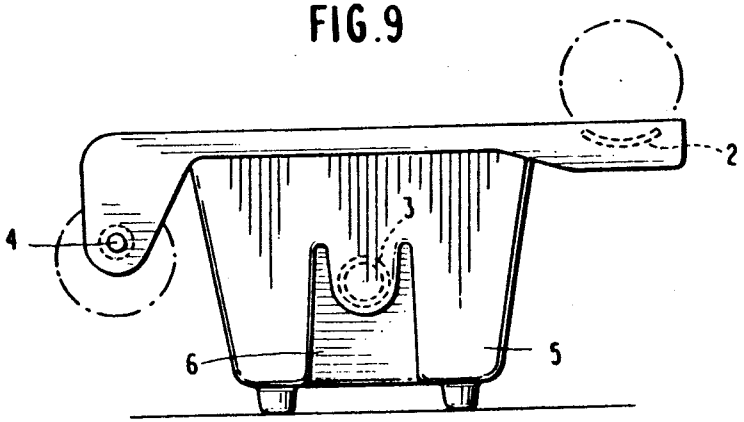
FIG. 9 is an end view taken along line 9—9 of FIG. 7.
Figure 8:
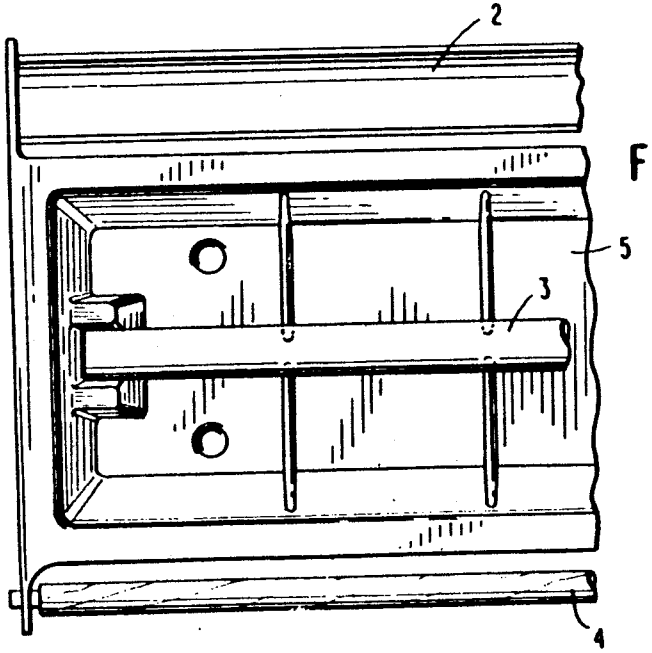
FIG. 8 is a fragmentary top view of the tray of FIG. 7.

In a second embodiment, baffles 6 are provided extending across the trough and underneath the guide 3, as shown in FIGS. 9 and 10. The baffles 6 help guide the paper flow underneath the guide 3, and keep the water from sloshing out of the tray when it is moved.

In a third embodiment of the present invention, the wallpaper tray 1 is formed as a single molded unit, which can be made of plastic or a similar material. This embodiment is shown in FIGS. 7–10.

As seen above, the wallpaper tray of the present invention provides significant improvements over that of the prior art.

I claim:

1. A tray apparatus for use in wetting rolled wallpaper sections comprising:

trough means for holding a wetting agent;

shelf means attached to an outer portion of said trough means so that a space exists between said shelf means and said trough means, said shelf means supporting a rolled wallpaper section; and guide means attached to said trough means and extending across said trough means below the level of said wetting agent, wherein said rolled wallpaper section is pulled through said space, into said trough means, under said guide means, and out of said trough means.

2. A tray apparatus as claimed in claim 1, further comprising baffle means extending across said trough means and under said guide means.

3. A tray apparatus for use in wetting rolled wallpaper sections comprising:

trough means for holding a wetting agent;

shelf means attached to a first outer portion of said trough means so that a space exists between said shelf means and said trough means, whereby a rolled wallpaper section is supported by said shelf means, and an end of said rolled wallpaper section is pulled through said space and into and out of said trough means.

4. A tray apparatus as claimed in claim 3, further comprising dispenser rod means attached to a second outer portion of said trough means for holding a roll of wallpaper.

5. A tray apparatus as claimed in claim 4, wherein said dispenser rod means is used to extend a section of wallpaper to a desired length for cutting.

6. A tray apparatus as claimed in claim 5, wherein said dispenser rod means is located at a portion of said tray directly below said shelf means.

7. A tray apparatus as claimed in claim 5, wherein said dispenser rod means is located at an opposite side of said trough from said shelf means.

8. A tray apparatus for dispensing and wetting wallpaper, said tray apparatus comprising:

trough means for holding a wetting agent;

guide means attached to said trough means and extending across said trough means below the level of said wetting agent;

shelf means attached to a first outer portion of said trough means;

dispenser rod means attached to a second outer portion of said trough means for holding a roll of prepasted wallpaper;

wherein said dispenser rod means is used to extend a section of wallpaper to a desired length for cutting, and a cut section of wallpaper is placed on said wallpaper shelf means, drawn under said wallpaper shelf means, passed under said guide means, and withdrawn to the surface of the tray, thereby wetting said cut section.

9. A tray apparatus as claimed in claim 8, wherein said dispenser rod means is located at a portion of said tray directly below said wallpaper shelf means.

10. A tray apparatus as claimed in claim 8, wherein said dispenser rod means is located at an opposite side of said trough from said wallpaper shelf means.

11. A tray apparatus as claimed in claim 8, further comprising baffle means extending across said trough means and under said guide means.

12. A tray apparatus as claimed in claim 8, wherein said tray is formed as a single molded unit.

* * * * *